United States Patent [19]

Lala

[11] 4,248,150

[45] Feb. 3, 1981

[54] COMBINED SQUEEGEE AND FLOOD BAR FOR AUTOMATIC PRESSES

[75] Inventor: Louis A. Lala, Skokie, Ill.

[73] Assignee: American Screen Printing Equipment Company, Chicago, Ill.

[21] Appl. No.: 23,714

[22] Filed: Mar. 26, 1979

[51] Int. Cl.[3] ..... B41F 15/44

[52] U.S. Cl. ..... 101/123; 74/424.8 A

[58] Field of Search ..... 101/123, 124; 74/424.8 A

[56] References Cited

U.S. PATENT DOCUMENTS

| | | | |
|---|---|---|---|
| 1,815,504 | 7/1931 | Görner | 101/123 |
| 1,922,710 | 8/1933 | Owens | 101/123 |
| 2,463,263 | 3/1949 | Gordon | 74/424.8 A |
| 3,139,823 | 7/1964 | Landesman | 101/124 |
| 3,263,603 | 8/1966 | Fuchs | 101/123 |
| 3,359,895 | 12/1967 | Forslund | 101/123 |
| 3,828,671 | 8/1974 | Fuchs | 101/123 |
| 3,885,493 | 5/1975 | Jaffa | 101/123 |
| 4,023,431 | 5/1977 | Pavlas | 74/424.8 A |
| 4,111,118 | 9/1978 | Green et al. | 101/123 |
| 4,180,187 | 12/1979 | Ben Haim | 74/424.8 A |

FOREIGN PATENT DOCUMENTS

| | | | |
|---|---|---|---|
| 702298 | 3/1966 | Italy | 101/123 |
| 717447 | 10/1954 | United Kingdom | 101/123 |
| 789175 | 1/1958 | United Kingdom | 101/123 |

*Primary Examiner*—William Pieprz

*Attorney, Agent, or Firm*—Robert E. Wagner; Gerald T. Shekleton

[57] ABSTRACT

A flood bar actuator for initiating the flood cycle in a universal screen printing machine is described. The squeegee assembly is mounted for vertical movement relative to the screen. The flood bar assembly is mounted adjacent the squeegee assembly, with an inner end fixedly mounted to an accessory support, and an outer end pivotally attached to the inner end. A peg extending from the squeegee assembly forces the flood bar up in the print cycle and allows the flood bar to drop onto the screen during the flood cycle. The height of the flood bar is adjustable through the rotation of the screw seated in an opening formed by a split support block forming the opening. A first half of the split support block is pivotally attached to the inner flood bar support as described, while the flood bar is supported from the second movable half. This second movable half has a threaded channel formed in its walls while the first channel has smooth walls. With this structure, on the rotation of the screw, the second half will be vertically moved relative to the first half for adjustment of the height of the flood bar relative to the screen.

8 Claims, 7 Drawing Figures

COMBINED SQUEEGEE AND FLOOD BAR FOR AUTOMATIC PRESSES

BACKGROUND OF THE INVENTION

This invention relates to screen printing presses in general and in particular, to a means for driving a squeegee and flood bar across a printing screen and alternately reversing their positions during respective print and flood cycles.

In a conventional screen printing operation after a printing cycle a pool of ink must be directed back by the flood bar across the screen towards the starting position of the squeegee in what is known as a flood stroke. The screen is placed in contact with the object being printed and the squeegee is lowered onto the screen while the flood bar is raised off the screen. The squeegee is then drawn back across the screen to force the ink through the screen onto the object in the areas desired and thereby print the message or artwork.

Various means have been devised to drive a squeegee and a flood bar mounted on what is often called the carriage, across the screen and reverse their relative vertical positions during the press cycle. For instance, U.S. Pat. No. 3,955,501 to Bubley and Oltra, present a workable solution for flat bed presses. U.S. Pat. No. 4,111,118 to Green et al. and application Ser. No. 827,738 to Bubley et al. both teach a squeegee and flood bar apparatus for use with three dimensional presses, for printing of circular, oval or flat objects as desired.

It is with this latter type of printing press, often termed a universal printing press because of its capability of printing on both flat and curved surfaces, that the squeegee and flood bar actuator of the subject invention is intended to be used with. In addition to the above-mentioned patents, U.S. Pat. No. 3,090,300 to DuBuit teaches the universal screen printing press of a type on which the subject invention may be used. Also, co-pending application Ser. No. 927,553 to Lala teaches a universal screen printing press as may utilize the squeegee and flood bar actuator of the subject invention.

SUMMARY OF THE INVENTION

Therefore, an object of the subject invention is an improved squeegee and flood bar actuator for use with universal screen printers.

A further object of the subject invention is an improved squeegee and flood bar actuator having a flood bar which may be adjusted in height to compensate for wear, screen tension and the like.

A still further object of the subject invention is a squeegee and flood bar actuator in which the flood bar is directly responsive to the movement of the squeegee, for assurances of correct flood bar operation while requiring few machined parts in a simple and inexpensive apparatus.

Yet another object of the subject invention is a squeegee and flood bar actuator whereby each of the squeegee and flood bar plates may be easily removed for replacement and/or cleaning as desired.

These and other objects are attained in accordance with the subject invention wherein there is provided a simple and inexpensive means for making a flood bar responsive to the vertical movement of the squeegee assembly. The actuating means of the subject invention provides a positive force for lifting the flood bar off the screen during the printing cycle of the printing press. While the squeegee is in the up or flood position over the screen, gravity provides sufficient force to drop the flood bar onto the screen during the flood cycle of the printing press operation.

The squeegee and flood bar assemblies of the subject invention are mounted on universal printing presses which may either be of the mechanical Geneva Cam type drive as in U.S. Pat. No. 4,111,118 and U.S. Pat. No. 3,090,300, or the press may be pneumatically driven as in application Ser. No. 927,553. Regardless of the type drive used, in such universal printing presses, the squeegee assembly is generally attached to the vertical support member or linkage arm, which is mounted on a pair of spaced shafts for lateral movement or no movement, dependent on whether flat or cylindrical objects are being printed. In general, as the support shafts are moved vertically, the squeegee support member is also moved vertically, albeit at a faster rate, thereby lifting the squeegee off the screen. The flood bar assembly has a flood bar mount which may be rigidly attached to the vertical support member for positioning of the flood bar assembly to one side of the squeegee assembly. One end of each of a plurality of extension rods are pivotally mounted to the flood bar support block in parallel. The opposite end of each of these rods is pivotally mounted to an outer support block. By these pivotal rods, the outer support block may move vertically relative to the inner support block. The flood bar support rod extends out from and is fixedly attached to the outer support block. The flood bar depends from and is attached to this support rod. The height of the flood bar in a vertical mode may be adjusted by positioning the outer support block. The outer support block has two halves, one half being pivotally attached to the inner support block as described above. The one half is loosely secured to the other half to allow vertical movement. The movable half is threaded for engagement with a screw while the stationary half has no threads. Thus, on rotation of the screw, the vertical height of the flood bar may be adjusted.

A projecting peg extends laterally from the squeegee support member for contact with one of the pivoting bars mentioned above. As the squeegee assembly is lifted off the screen and let back down again in its reciprocal movement, the peg forces the inner end of the pivot rod down to bring the flood bar up into the print position. The upward movement of the squeegee assembly breaks contact of the peg with the pivoting bar and allows gravity to bring the flood bar into the operative position against the screen during the flood cycle. By such an apparatus, a minimum number of operating parts and machining are necessary in order to perform the required operations. Such an assembly does not require precisely aligned elements and is completely responsive to changes in the print stroke, requiring no adjustment other than those required to change the print stroke itself.

DESCRIPTION OF DRAWINGS

Further objects of the invention, together with additional features contributing thereto and advantages accruing therefrom will be apparent from the following description of one embodiment of the invention when read in conjunction with the accompanying drawings wherein:

FIG. 4 is a side plan view of the flood bar mounting assembly of the subject invention showing the flood bar mounting assembly in the flood position.

FIG. 5 is a side plan view of the flood bar mounting assembly of the subject invention showing the flood bar mounting assembly in the print position.

FIG. 6 is an exploded partial view of the flood bar mounting assembly of the subject invention, showing the adjustability of the outer flood bar mount relative to the inner flood bar mount.

Referring now to FIG. 1, there is shown a portion of a universal printer known as a Phase 4, which is manufactured and sold by American Screen Printing Equipment Company, Assignee of the present invention. A screen printing press 10 such as shown has parallel shafts 13 and 14 which are reciprocated vertically by a suitable drive means. A screen 11 is supported between screen supports 12 which are themselves attached to and supported by a pair of spaced linkage arms 15 mounted on the shafts 13 and 14 and capable of lateral movement as desired. An accessory support mount 16 is also slidably mounted to shafts 13 and 14 in a position between linkage arms 15. As stated, both linkage arms 15 and accessory support mount 16 are laterally movable on shafts 13 and 14. In fact, the screen may be connected to a drive means (not shown) for lateral movement while the accessory support mount is held stationary for the printing of cylindrical or oval objects. When printing flat objects, such as cardboard sheets, labels or the like, the screen can be held immobile while the accessory support mount is moved laterally along the shafts 13 and 14 by appropriate connection to the drive means. As this function is described sufficiently elsewhere (U.S. Pat. No. 4,111,118 among others) such detail will not be repeated here.

Figure 1:
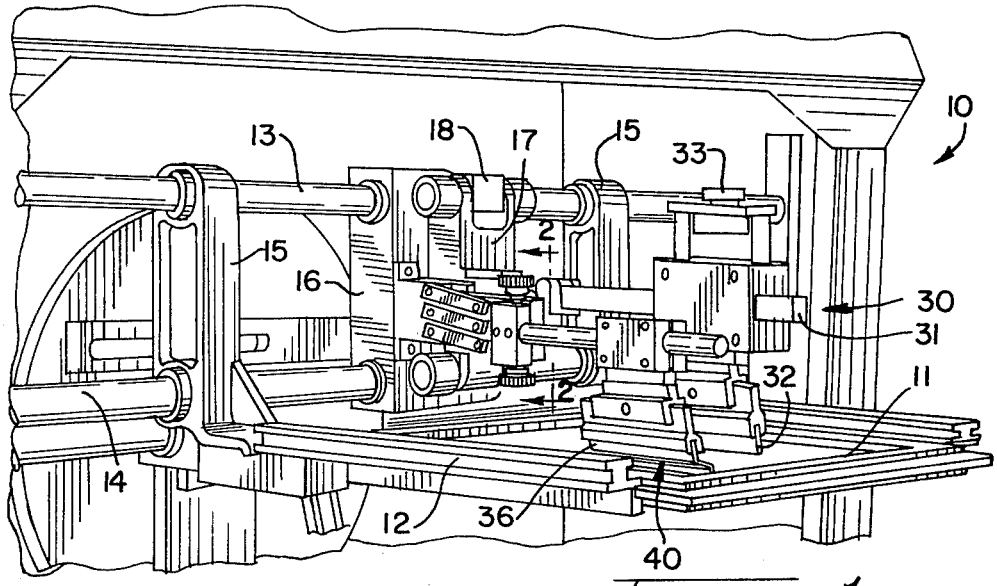
FIG. 1 is a perspective view of a squeegee and flood bar assembly employing an embodiment of the subject invention as mounted on a universal screen printing press.

Mounted on the accessory support mount 16 is the squeegee assembly support 17. It is sufficient to note that the squeegee assembly support 17 is pivotally mounted for parallelogramatic movement relative to the accessory support 16 so that upon the vertical movement of the shafts 13 and 14 lift members 18 will cause the squeegee assembly mount 17 to raise and lower at a rate faster than the movement of the screen 11 itself. Further disclosure concerning the manner of providing for such movement may be found in the application to Lala, Ser. No. 927,553 and the application to Bubley et al., Ser. No. 827,738. As in the above application to Bubley et al., the squeegee assembly is mounted to the squeegee assembly mount 17 by a bar 31 from which the squeegee 32 depends, in a manner in which the height of the squeegee 32 may be easily adjusted by micrometer knob 33 at the top of the squeegee assembly 30.

In general terms, as the squeegee assembly is raised and lowered in conjunction with the motion of the squeegee assembly mount 17 as described above, the flood bar is also raised and lowered, though in the opposite direction as that of the squeegee assembly 30.

Figure 3:
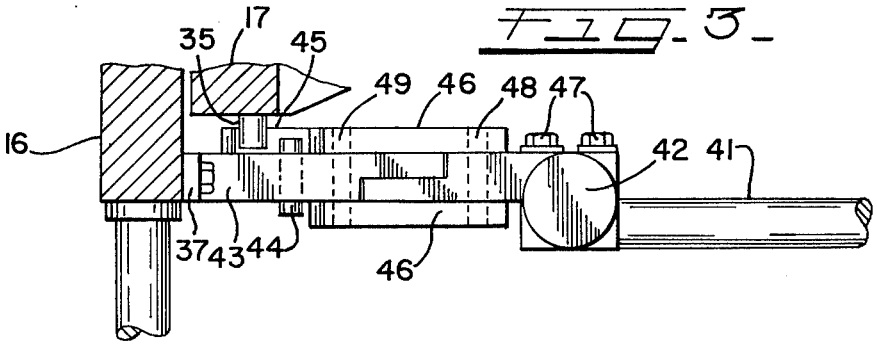
FIG. 3 is a partial top plan view taken along the lines 3—3 of FIG. 2 showing the joinder of the outer squeegee mounting block with the inner mounting block.
Figure 2:
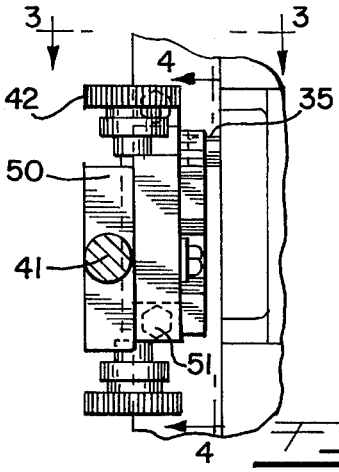
FIG. 2 is a cross section taken along the lines 2—2 of FIG. 1 showing the outer squeegee mounting block.
Figure 7:
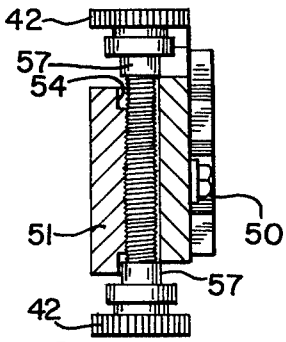
FIG. 7 is a cross section of a view taken along the lines 7—7 of FIG. 4.

The flood bar itself is mounted on the accessory mount 16 as best shown in FIGS. 4 and 5. The inner flood bar accessory mounting block 43 is attached to the accessory mount 16 by suitable bolts through ears 37 of the inner mounting block 43. The outer support block 51 is attached to the inner mounting block for vertical movement as will be explained, and supports a rod 41 from which the flood bar 36 depends. Outer support 51 and flood bar mounting block 43 are disposed adjacent one another in a loose mating relationship, as shown in FIG. 3.

As shown in FIGS. 4 and 5, the outer flood bar support 51 is attached to the inner mounting block 43 by at least one leg member 46. For additional lateral stability, a leg member may be secured to each mounting block on the opposite side of the block, or a plurality of leg members on each side for optimum stability may be used as shown. Each leg member is secured at one end to the outer support block 51 for pivotal movement and is secured in a similar fashion to the inner mounting block 43 for pivotal movement. Leg members 46 may be attached in this manner to each of the support block 51 and inner mounting block 43. In this manner, the outer supporting block 51 may move vertically in a reciprocal fashion relative to the inner mounting block 43.

As best shown in FIGS. 4 and 5, on the side of the flood bar assembly facing the squeegee assembly, one of the leg members 46 and preferably a central leg member, has an extended length 45 which extends an additional distance beyond the end of leg members 46. Such additional distance may approximately equal one third of the length of a leg member 46, although the additional length may be variable, being limited only by the distance to the accessory mount 16. Pegs 38 and 39 serve as limit stops for limiting the vertical movement of outer support 51 by limiting the movement of the extended section 45 of the central leg member.

Peg 35 is fixedly secured on a side of squeegee assembly support 17. The end extends out from the squeegee assembly mount 17 to a point adjacent yet spaced from flood bar inner mount 43 for contact with an upper edge of the extended length 45 of a leg member. By such contact, movement of the peg 35 in a downward direction will cause the extended portion 45 of the leg member with which it is in contact to move downwardly also, and cause the outer support block 51 to move upward, as well as the rod 41 and the flood bar which depends on the rod 41. In this manner, as the squeegee assembly is driven in a downward direction for contact with the screen, peg 35 moves the flood bar off the screen, as shown in FIG. 5. The flood bar will remain in this position during the print cycle of the screen printing machine. When the printing cycle is finished, peg 35 is raised, allowing the flood bar to drop due to the forces of gravity until the extended portion 45 of the leg member 46 contacts stop 39, thereby bringing the flood bar into contact with the screen for the flood cycle (FIG. 4).

In order to compensate for wear of the flood bar, tension of the screen and other variables which tend to affect the efficiency of the flood bar in its travel across the screen when pushing the pool of ink to the other side of the screen for the start of another printing stroke, the relative height of the flood bar must be adjustable. The flood bar assembly of the subject invention accomplishes such compensation in a novel manner, while requiring a minimum of machined parts and parts in general to provide a simple, inexpensive yet reliable means of adjusting the relative height of the flood bar. As best shown in FIG. 6, the outer flood bar support half 51 has a mating half 50. Both halves 50 and 51 have mating channels or recessions 55 and 56 respectively, which form a cylindrical tunnel or passageway when the two halves are mated. A semicircle 54 of increased diameter is formed on one or both sides of channel 55. In comparison to channel 56, channel 55 has threads formed in its walls while no such threads exist in channel 56.

Flood bar support half 50 has threaded openings 57 which may extend only partially into lock half 50. Support rod 41 is fixedly and rigidly secured in cantilever fashion to support half 50. A screw 49 having knurled knobs 42 fixedly secured at opposite ends is mounted within the passageway of the mated support halves 50 and 51. An inner portion 57 of each knurled knob is of reduced diameter for inclusion into semicircle 54, when adjusting the flood bar height. Screws 53 are inserted through slots 52 and tightened within opening 58 in the mating half of the flood bar support 50 to secure the flood bar at the desired height. Adjustment of the height of the flood bar may be accomplished by the rotation of the knurled knobs 42. Because no thread exists in channel 56 there is no effect on support half 51 caused by the rotation of the screw 49. However, the threaded channel 55 and thus the support half 50 are responsive to the screw rotation for vertical movement. The increased diameter semicircle 54 allows greater movement of the screw and thus more adjustment latitude, by acceptance of the reduced diameter portion 57 of the knurled knob.

In operation, the action of the squeegee and flood bar assembly takes place regardless of whether the press is set up for oval or flat printing, i.e., whether the screen is attached for lateral movement or the squeegee assembly is attached for lateral movement on a stationary screen. Therefore, when the squeegee assembly is in the print mode and in contact with the screen, the flood bar is elevated as peg 35 depresses the extended end 45 of one of the leg members 46. When the squeegee assembly reaches the end of the print stroke and the screen is raised off the object being printed, the squeegee assembly is simultaneously elevated off the screen 11 thus raising peg 35 and allowing the flood bar assembly to drop to a point where the flood bar 36 comes into contact with the screen 11. The height of the flood bar has been adjusted prior to initiating the printing cycle by rotation of the knurled knob 42 to assure correct positioning and height of the flood bar 36 in relation to the screen 11. The flood bar 36, while in this flood mode, is moved across the screen pushing the pool of ink to one side of the screen. When the flood bar 36 reaches the side of the screen, the flood mode is ended, and the squeegee 32 is dropped, elevating the flood bar 36 off the screen. The screen 11 is simultaneously dropped back onto another article to be printed and the print mode is initiated once again.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

I claim:

1. A squeegee and flood bar assembly for use with a printing press for the simultaneous opposite reciprocal movement of said squeegee and flood bar relative to a screen comprising a squeegee assembly mounted on a first mounting means for vertical movement, a flood bar, assembly mounted on said printing press independent of said squeegee assembly, said flood bar assembly comprising a flood bar depending from a rod, said rod supported in cantilever fashion by an outer support block, a leg member being attached to each of said inner and outer support blocks, the attachment being pivotal at least with said inner block, said leg member having an extended end portion beyond the pivotal attachment with said inner support block, a peg extending laterally from said first mounting means to a point spaced from said inner support block for contact with said extended end portion, said peg moving downward with the movement of said first mounting means and driving said extended end portion of said leg member downward, pivoting said rod and said flood bar upward for the print cycle and allowing said flood bar to drop downward onto the screen in the flood mode.

2. The squeegee and flood bar assembly of claim 1 wherein said leg member is pivotally attached to said outer support block at an end portion and pivotally attached to said inner support block at an opposite end portion.

3. The squeegee and flood bar assembly of claim 1 wherein said outer support block has a first vertical surface closely adjacent a second vertical surface of said inner support block, thereby aiding in the retention of said flood bar in a substantially horizontal position when raised off the screen by forcing said outer block to conform said first vertical surface to said second vertical surface of said inner support block.

4. The squeegee and flood bar assembly of claim 1 wherein said inner support block and said outer support block form an overlapping joint means for preventing lateral movement and increasing stability of said flood bar during movement of said flood bar across the screen.

5. A flood bar assembly for use in conjunction with a squeegee in a screen printing press to alternately push ink across and through a screen with the squeegee and push the unused ink back across the screen to a starting point with a flood bar, said flood bar assembly including a blade extending horizontally across the screen, said blade being raised in vertical motion from an operative position in the flood mode to an inoperative position in the print mode, said blade being adjustable in height for contact with said screen in said operative position and for exertion of a desired amount of tension on said screen by said blade, said blade depending from a first support block portion, said first support block portion being movably attached to a second support block portion along opposing vertical faces, first and second vertical channels formed in respective faces, said first channel in said first support block portion having threads formed therein and said second channel in said second support block portion having a substantially smooth channel, said first and second channels forming a cylindrical passageway when said first support block portion is attached to said second support block portion along said faces, said cylindrical passageway accepting a threaded rod, said threaded rod engaging said threaded first channel for vertical movement of said first support block portion and no movement of said second support upon rotation of said threaded rod, a knob means on an end of said threaded rod, said knob means having an inner end of reduced diameter, and said first support block portion having an enlarged channel end portion, said inner end of said knob means being receivable within said enlarged channel end portion, whereby said first support block portion and flood bar are movable in a large span of height adjustment for contact with the screen and exerting a desired degree of tension on the screen in the flood mode.

6. The flood bar assembly of claim 5 wherein said first support block portion may be locked in a desired position after moving said flood bar to said desired height.

7. The flood bar assembly of claim 5 wherein the opposing ends of each of said knob means and said first support block means are identical for greater span of adjustment of the height of said flood bar.

8. A combined squeegee and flood bar assembly for use with a screen printing press, said screen printing press having a flood bar assembly squeegee assembly and a first drive means for providing vertical movement of said squeegee, said squeegee and flood bar assembly operating to alternately place a squeegee and a flood bar on and off a screen in the printing and flood modes, said squeegee being supported by squeegee support means, said flood bar being supported by a flood bar support means, said flood bar support means including a first and a second block portion, said first block portion supporting said flood bar, said second block portion being secured to an accessory mount, said first block portion being secured to said second block portion by a connecting member at a point for pivotal movement of said connecting member about said point, said connecting member having a portion extending beyond said point, a second drive means comprising an extension of said squeegee support means engageable with said extended portion of said connecting member to move said first block portion vertically while said second block portion remains stationary relative to said accessory mount and thereby vertically move said first block portion and said flood bar relative to said squeegee.

* * * * *